United States Patent [19]

Piesik

[11] Patent Number: 4,934,241

[45] Date of Patent: Jun. 19, 1990

[54] ROCKET EXHAUST DEFLECTOR

[75] Inventor: Edward T. Piesik, Pomona, Calif.

[73] Assignee: General Dynamics Corp. Pomona Division, Pomona, Calif.

[21] Appl. No.: 119,375

[22] Filed: Nov. 12, 1987

[51] Int. Cl.[5] ..... F41F 3/04

[52] U.S. Cl. ..... 89/1.817; 89/1.8; 89/1.816

[58] Field of Search ..... 89/1.817, 1.812, 1.8, 89/1.816

[56] References Cited

U.S. PATENT DOCUMENTS

| | | | |
|---|---|---|---|
| 2,445,423 | 7/1948 | Eastman | 89/1.8 |
| 2,780,143 | 2/1957 | Graham | 89/1.817 |
| 3,052,303 | 9/1962 | Lapp | 89/1.8 |
| 3,081,970 | 3/1963 | Einarsson | 89/1.8 |
| 3,088,374 | 5/1963 | Guyant et al. | 89/1.817 |
| 3,158,062 | 11/1964 | Feiler | 89/1.817 |
| 3,468,213 | 9/1969 | Hersh et al. | 89/1.812 |
| 3,499,364 | 3/1970 | D'Ooge | 89/1.817 |
| 3,645,478 | 2/1972 | Madelung | 244/114 B |
| 3,766,828 | 10/1973 | Cords | 89/1.816 |
| 4,044,648 | 8/1977 | Piesik | 89/1.812 |
| 4,134,327 | 1/1979 | Piesik | 89/1.812 |
| 4,134,328 | 1/1979 | Asp et al. | 89/1.817 |
| 4,173,919 | 11/1979 | Piesik | 89/1.816 |
| 4,186,647 | 2/1980 | Piesik | 89/1.816 |
| 4,324,167 | 4/1982 | Piesik | 89/1.812 |
| 4,336,740 | 6/1982 | Leigh et al. | 89/1.816 |
| 4,373,420 | 2/1983 | Piesik | 89/1.812 |
| 4,433,606 | 2/1984 | Hagelberg et al. | 89/1.812 |
| 4,471,684 | 9/1984 | Johnson et al. | 89/1.817 |
| 4,480,522 | 11/1984 | Piesik | 89/1.819 |
| 4,545,284 | 10/1985 | Piesik | 89/1.819 |
| 4,683,798 | 8/1987 | Piesik | 89/1.812 |
| 4,686,884 | 8/1987 | Piesik | 89/1.816 |

*Primary Examiner*—David H. Brown

*Attorney, Agent, or Firm*—Angus C. Fox, III

[57] ABSTRACT

A missile canister hatch cover is provided which deflects the rocket exhaust from an adjacent uptake channel away from a missile as it leaves the canister. After diverting the uptake exhaust flow away from the missile, the hatch cover is returned to its closed position by the missile rocket exhaust as the missile nozzle clears the canister opening. Overall wear and tear on the launching system from the rocket exhaust is reduced and the uptake flow plume is stopped from expanding above the launcher. During missile launch the hatch cover is unlatched and spring loading opens it more than 90° to a locked position where it interferes with the exhaust flowing from the uptake. The interference deflects the uptake flow away from the missile during flyout to avoid the heating, side thrusts, and contamination associated with the uptake exhaust flow field. After the missile clears the canister and the rocket exhaust begins to impinge on the hatch cover, the hatch cover is unlocked from its open position by actuation of a drag flap that is deployed to help close the hatch cover. An ablative material is applied to exposed surfaces of the hatch cover to prevent heat damage while it is deflecting the uptake exhaust flow.

23 Claims, 4 Drawing Sheets

FIG. 1
(PRIOR ART)
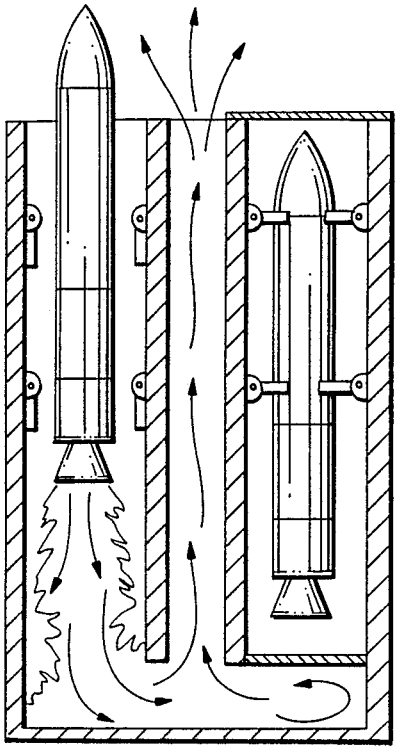
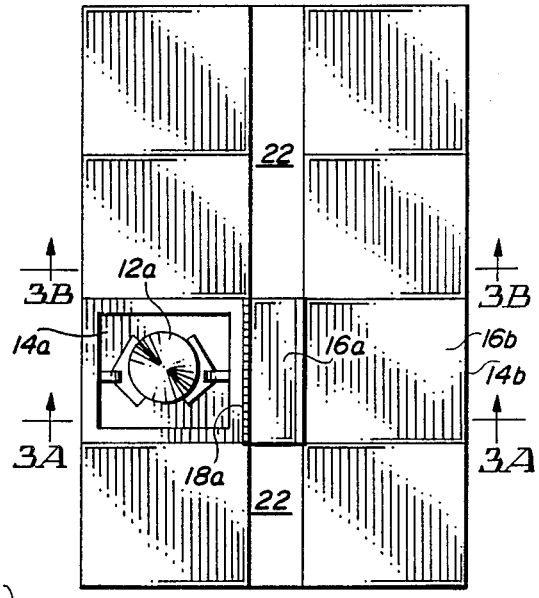
FIG. 3
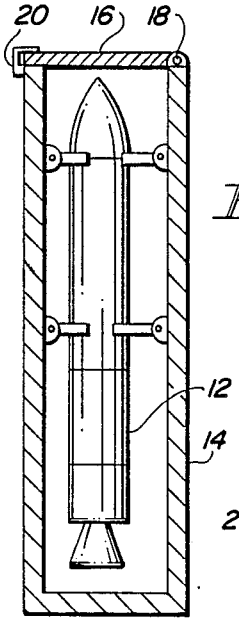
FIG. 2
FIG. 3A
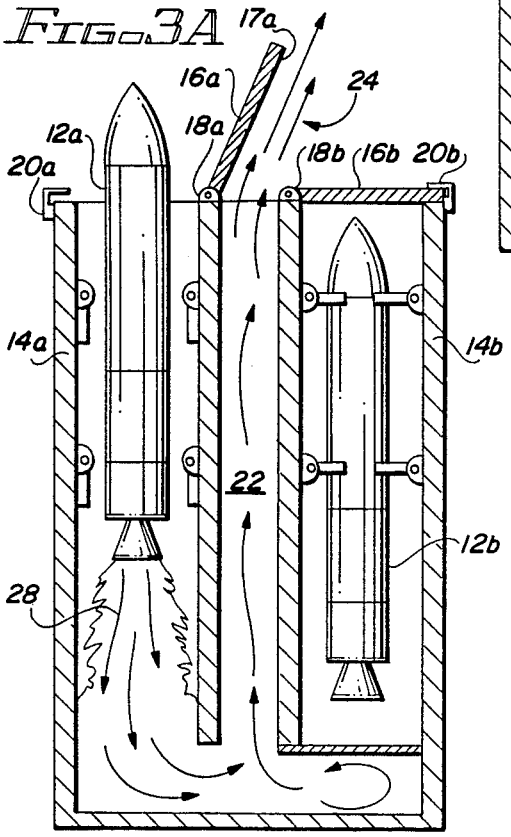
FIG. 3B
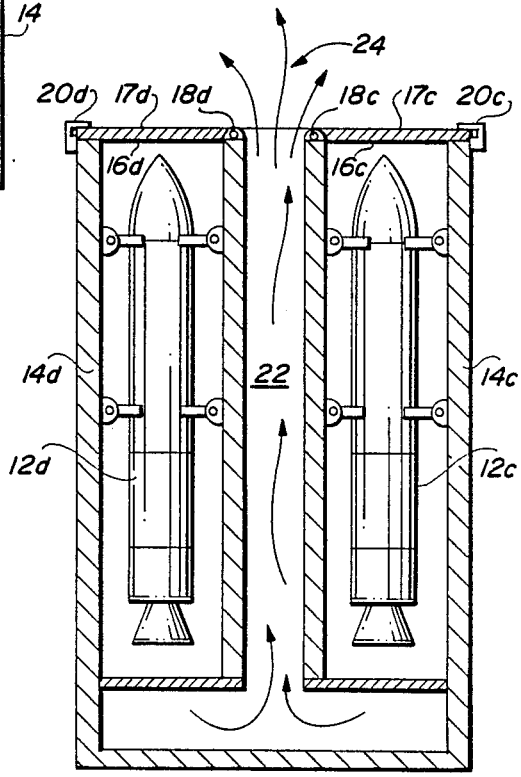

ROCKET EXHAUST DEFLECTOR

Background of the Invention

1. Field of the Invention

The present invention relates to missile launching systems and, more particularly, to arrangements for preventing missile exhaust gases from having deleterious effects on the missile as it is being launched.

2. Description of the Related Art

In many military applications, missiles ready for launching are stored in closely adjacent magazine chambers, or canisters. In contemporary vertical launching arrangements, a missile must travel through its own rocket exhaust during the process of launching, as shown in FIG. 1. After firing has commenced, the rocket exhaust flows into a plenum and then out through an uptake channel, parallel to and in the same direction as the missile path. Because the missile moves through the exhaust gases, it is subject to the possibly deleterious effects of heating, sideload pressures, and contamination.

The prior art contains various examples of arrangements for controlling the flow of missile exhaust gases in order to prevent damage to the launching structure. In U.S. Pat. No. 4,044,648 to Piesik, apparatus is disclosed for controlling the flow of exhaust gases between a plurality of rocket storage chambers, launch tubes, or the like, and a common manifold for ducting rocket exhaust gases to a discharging location. During a rocket firing, manifold pressure causes doors other than those through which a rocket is firing to close and remain closed, thereby preventing circulation of rocket exhaust gases into non-firing rocket chambers.

U.S. Pat. No. 4,134,327 to Piesik discloses a rear door for a rocket launch tube to prevent rocket exhaust gas from flowing into an empty launch tube from an associated multiple-rocket plenum chamber. The door is maintained in a stored position while a missile is in the launch tube and is activated when the missile leaves the launcher. Preferably, gases from the missile being launched power closure of the door once the door is released from its open latched position. Once the door closes, a second latch locks it in place to seal off the launch tube from the plenum chamber.

In U.S. Pat. No. 4,173,919 to Piesik, a system is disclosed which utilizes a rocket plenum design of a form that reduces and controls combustion therein. The plenum is provided with two oppositely and upwardly extending exhaust ducts. Provision is made to eliminate blind pockets and stagnation passages in order to prevent possible explosions in the plenum during rocket firing.

U.S. Pat. No. 4,186,647 to Piesik discloses a rear cover for a rocket launch tube which is normally closed and which is capable of breaking away successively in one or more sections in response to the pressure and diameter of the rocket exhaust column or plume. The cover is so arranged that it successively increases the area interconnecting the launch tube for the rocket with an exhaust duct or manifold as the rocket plume increases in diameter. The cover of an adjacent launch tube which is normally closed prevents the exhaust gases from entering the launch tube of a stored rocket or the like. Another type of rear cover for rocket launch tubes is disclosed in U.S. Pat. No. 4,324,167 to Piesik. The rear cover provides a seal between the tube and the rear of the rocket, and the rocket is so arranged that the exhaust from a firing rocket produces a seal between a sealing member and the rear of the rocket to seal off the portion of the tube adjacent to the rocket itself. This prevents exhaust gases from entering that portion of the launch tube.

U.S. Pat. No. 4,373,420 to Piesik discloses a method and apparatus for preventing combustion of exhaust gases in rocket launch systems using a plurality of launch tubes connected to a plenum. A control system is provided which is sensitive to atmospheric pressure and launch tube pressure. A signal to an inert gas supply flow controller initiates flow into the plenum when pressure in a launch tube reaches a predetermined level after the launch of a rocket.

In U.S. Pat. No. 4,480,522 to Piesik, methods and apparatus are disclosed for preventing a missile's rocket exhaust gases from contacting and adversely affecting, such as by overheating, the launch rails from which a missile may be launched. Such apparatus includes orifices and pressure/flow controls in association with the rails in order to produce a cold gaseous stream directed in opposition to the exhaust gases during at least the initial phase. The stream creates a boundary plane or barrier between the rails and exhaust gases, thereby shielding the rails from damage due to overheating. Another apparatus for preventing a missile's rocket exhaust gases from damaging the launch rails from which a missile may be launched is disclosed in U.S. Pat. No. 4,545,284 to Piesik. The apparatus includes an angled member having first and second leg portions, the end of the first leg portion being pivotably secured to the rail. A member having an angled surface is mounted to the second leg portion. Prior to the launching of the missile, the apparatus is in a first operative position such that it is out of contact with the launch rail. When the exhaust gases are emitted from the missile, a portion of the exhaust is incident upon the angled surface which causes the apparatus to pivot into contact with the launch rail, whereby portions of two surfaces of the launch rail are protected from the exhaust. Other arrangements provide for translation as well as rotation of a pair of angled members in a clamshell configuration for protection of particularly shaped launch rails.

However, none of these prior art references teaches or suggests the concept of the present invention, which is to provide a means of deflecting the uptake exhaust flow locally away from the missile flight path that is deployed automatically or on command.

Summary of the Invention

In accordance with the present invention, a device is provided which deflects the rocket exhaust from an adjacent uptake channel away from a missile as it leaves a launch canister. After diverting the uptake exhaust flow away from the missile, the device is returned to its stowed position by the missile rocket exhaust as the missile nozzle clears the device. This automatic closing prevents any additional rocket exhaust from being channeled into the plenum; thus, overall wear and tear on the launcher is reduced and the uptake flow plume is stopped from expanding above the launcher. The device also functions as the launch canister hatch cover. This cover is hinged on the exhaust uptake side of the canister and is loaded to open, but is latched closed during assembly.

During missile launch, the latch is released on command (or under internal canister pressure) and the spring-loaded cover opens more than 90° (say 110°) and locks in place to interfere with the exhaust flowing from the uptake. The interference deflects the uptake flow away from the missile during flyout—thus avoiding the heating, side thrusts, and contamination associated with the uptake exhaust flow field. When the missile clears the canister and the rocket exhaust begins to impinge on the exposed hatch cover, a trigger mechanism on the exposed surface of the hatch cover functions under the influence of the rocket exhaust pressure and releases the hatch cover from its locked position. The trigger mechanism is part of a drag flap which is also released to a more exposed position under the influence of the rocket exhaust flow. The drag flap is structurally attached to the hatch cover, and the rocket exhaust serves to rotate the hatch cover toward a more closed position. The rotation is also encouraged by the influence of the uptake flow. When the hatch cover is open less than 90°, the missile exhaust accelerates the hatch cover to a fully reclosed position. With the top of the canister reclosed, the missile rocket exhaust no longer can enter the launcher system. The source of the uptake plume is eliminated from that time on.

An ablative material is applied to the top surface of the hatch cover to prevent heat damage while it is deflecting the uptake exhaust flow.

The mechanism which locks the hatch cover in its open position is a pawl-detent arrangement which mechanically limits the opening of the hatch cover to the desired angle. The hatch cover opening spring is deactivated when the hatch cover is unlocked from its open position concurrent with deployment of the drag flap. This reduces the resisting moment for reclosing and increases the reliability of relatching the hatch cover.

Brief Description of the Drawings

A better understanding of the present invention may be realized from a consideration of the following detailed description, taken in conjunction with the accompanying drawings, in which:

FIG. 1 is a schematic elevational view of a prior-art arrangement for missile storage and firing;

FIG. 2 is a schematic elevational view of a missile inside its canister with the device of the present invention serving as the hatch cover;

FIG. 3 is a plan view of a group of missiles in their canisters, all closed except for one in which the hatch cover has been deployed to an open position;

FIG. 3A is a section through two canisters separated by the uptake channel, as indicated in FIG. 3;

FIG. 3B is a section through two closed canisters separated by the uptake channel, as indicated in FIG. 3;

Description of the Preferred Embodiments

Figure 4A:
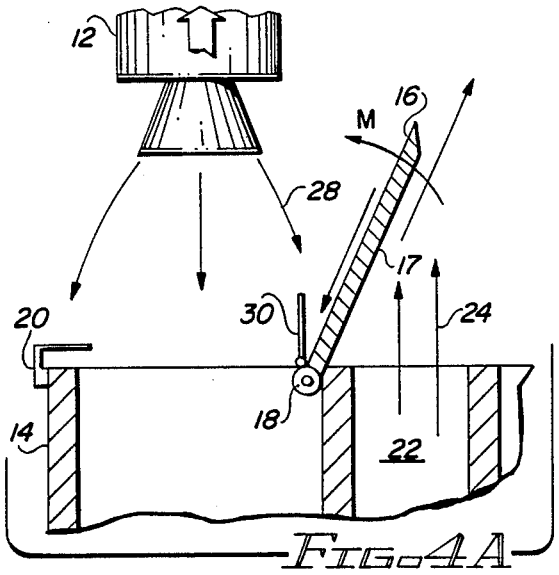
FIG. 4A is a sectional side view of a missile leaving its canister, showing the onset of deployment of the drag flap.

FIG. 1 shows a presently available arrangement for storing and firing missiles on board ship. A corresponding arrangement embodying the present invention is shown and described in conjunction with FIGS. 3–3B.

FIG. 2 shows a missile 12 inside a canister 14 which serves both as a shipping container and as a launch tube for the missile 12. A hatch cover 16 is attached to the canister 14 via a spring-loaded hinge 18. The hatch cover 16 is kept in a closed position by a latch 20.

FIG. 3 shows an arrangement of two groups of four missiles, each separated by an uptake channel 22. The hatch cover **16*a* of one of the canisters 14A is open as the missile 12*a* is being fired. As shown in FIG. 3A, the hatch covers 16*a* and 16*b* are attached by spring-loaded hinges 18*a* and 18*b* along the sides of the canisters 14*a* and 14*b* closest to the uptake channel 22. In naval applications the missiles as shown in FIG. 3 will typically be mounted below deck with the top of the assembly being flush with the deck of the ship. In preparation for launch, the hatch cover 16*a* is opened so that it extends upward at greater than a 90° angle. It provides protection against the interaction of the uptake flow 24 with the missile 12*a* exiting the canister 14*a* on the side where the opened hatch cover 16*a* is positioned. Ablative material 17*a* (FIG. 3A) covers the top surface of the hatch cover 16*a* to prevent thermal damage to the cover while it is exposed to the uptake exhaust flow 24. The ablative material 17*a*** may be anything used in the field: plastic, fiberglass, epoxy, carbon, boron, or the like with or without fibers entrained in it.

Hatch cover **16*a* is locked in position by a cover lock (not shown). The present invention provides that each individual canister cover 16, regardless of on which side of the uptake flow channel 22 the canister 14 is located, will provide the desired protection against interaction between the uptake exhaust 24 and the missile 12A. As shown in FIG. 3B, each canister cover 16 is hinged on the side next to the uptake channel 22. Unfired missiles 12*c* and 12*d* are protected in their canisters 14*c* and 14*d* by closed and latched hatch covers 16*c* and 16*d*. Although the canisters 14 and their covers 16** which are shown in the drawings are square in cross section, the present concept can readily be adapted to round or other non-square canisters and covers.

The cover 16 can be opened before launch or at the time the missile 12 is fired. A spring-loaded hinge 18 is included to provide a force tending to move the cover 16 to the open position as shown in FIGS. 3 and 3A.

Figure 4B:
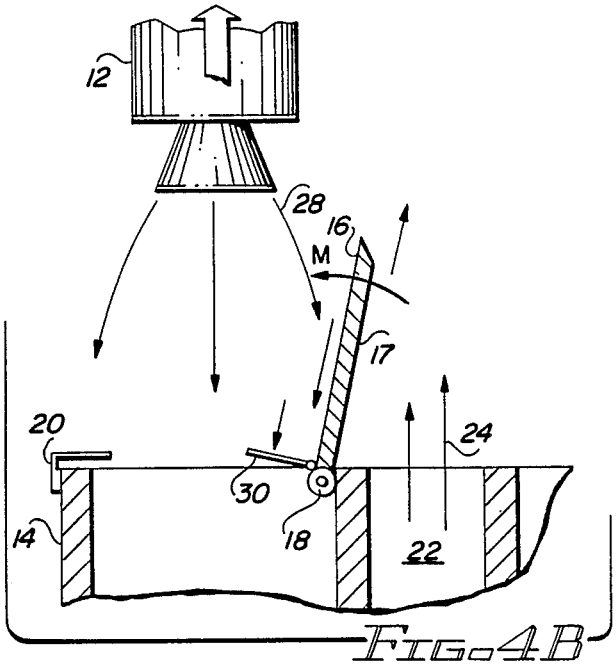
FIG. 4B is a sectional side view of a missile shown immediately following the view of FIG. 4A, with the drag flap fully deployed and the hatch cover rotating toward closure.

Referring now to FIGS. 4A and 4B, the spring loading is deactivated when a drag flap 30 starts to open, so that less force is required to close the cover 16.

FIG. 4B shows the drag flap 30 in its fully deployed position, with the force of the missile exhaust plume 28 acting on the drag flap 30 to create a torque M which (in conjunction with the torque from the uptake flow 24 acting on the uptake side of the hatch cover 16) tends to rotate the hatch cover 16 toward its closed position.

Figure 5A:
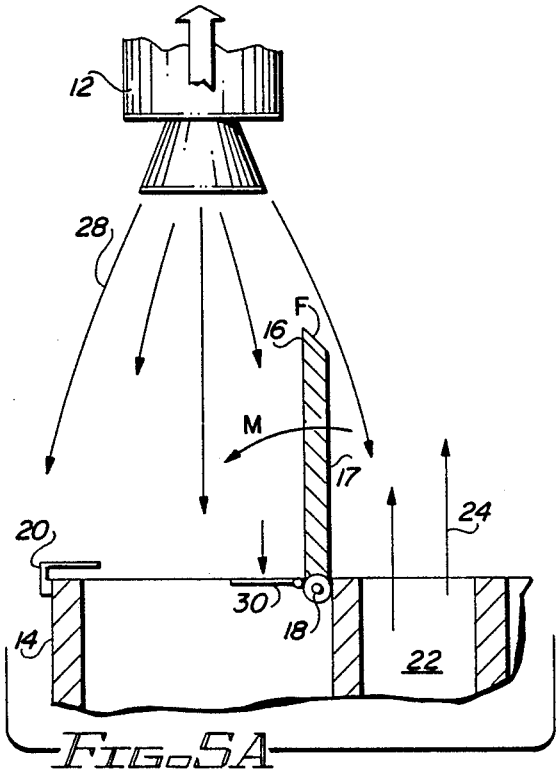
FIG. 5A is a sectional side view of the situation in which the hatch cover is at its 90° open position.

FIG. 5A shows the hatch cover 16 in its 90° open position. The drag flap 30 is in its fully deployed position and the exhaust plume 28 exerts its maximum force on the drag flap 30 at this time. There is also a small force component F on the beveled edge of the hatch cover 16 due to the exhaust plume 28 and a small side force due to the uptake flow 24 acting on the uptake side of the hatch cover 16.

Figure 5B:
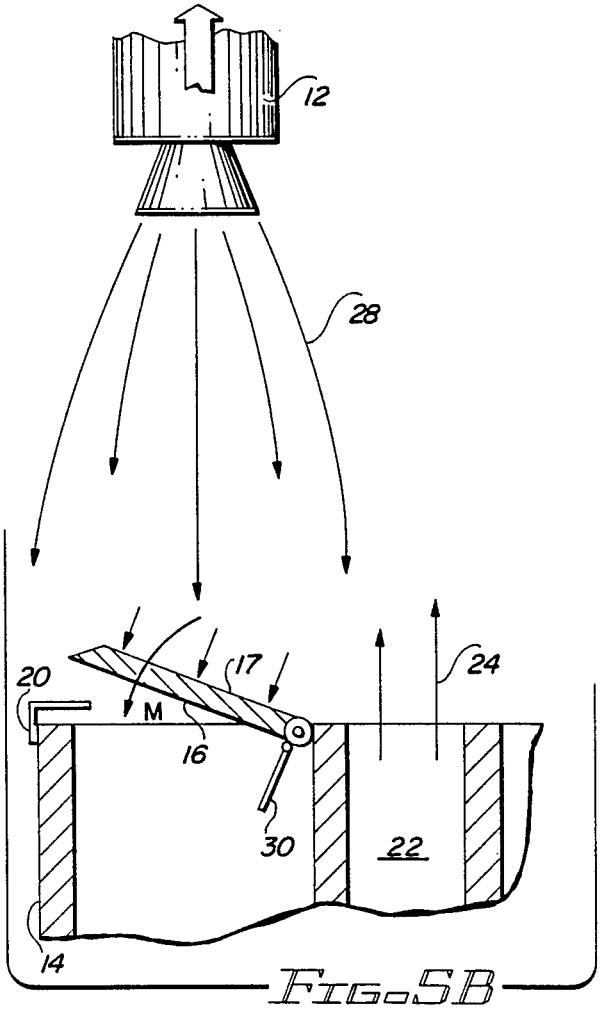
FIG. 5B is a sectional side view of the missile rocket exhaust closing the hatch cover.
Figure 5C:
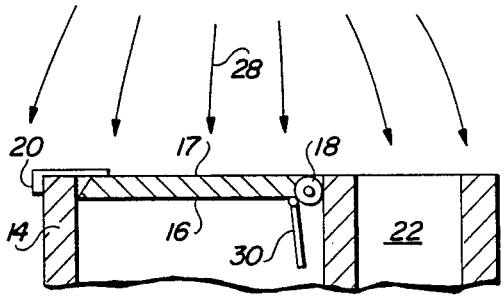
FIG. 5C is a sectional side view showing the hatch cover closed and relatched.

FIG. 5B shows the hatch cover 16 accelerating toward its closed position due to exhaust plume 28 impinging on the top of hatch cover 16. FIG. 5C shows the hatch cover 16 in its closed and re-latched position.

Figure 6:
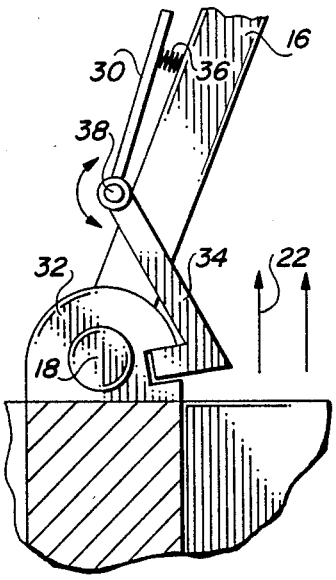
FIG. 6 is a sectional side view of a self-locking arrangement for the hatch cover, shown in the fully opened position.

One possible embodiment of the locking arrangement for the hatch cover 16 in the full-open position is shown in FIG. 6. The hatch cover 16 rotates due to an opening force from a horizontal closed position to an open position about 110° with respect to the horizontal. The cover 16 is locked open in this position by the detent in hatch cover hinge support 32 and pawl 34 arrangement shown. A spring 36 forces the pawl 34 into a detent in the hinge support 32 to prevent counter-rotation once the open position is attained. The drag flap 30 and pawl 34 are rigidly connected at the hinge 38 of the drag flap 30. Activation of the drag flap 30 by the rocket exhaust 28 provides a force which acts on pawl 34. Pawl 34 is disengaged from the detent in hinge support 32 to release hatch cover 16 from its open position.

This concept is unique in that the missile position above the canister automatically initiates the drag flap activation as the rocket exhaust plume flows into the drag flap opening. The rocket exhaust dragging on the drag flap provides the energy both to disengage the pawl from the hatch cover hinge support and to deactivate the hinge spring (as next described), and subsequently start the closing of the hatch cover.

Figure 7:
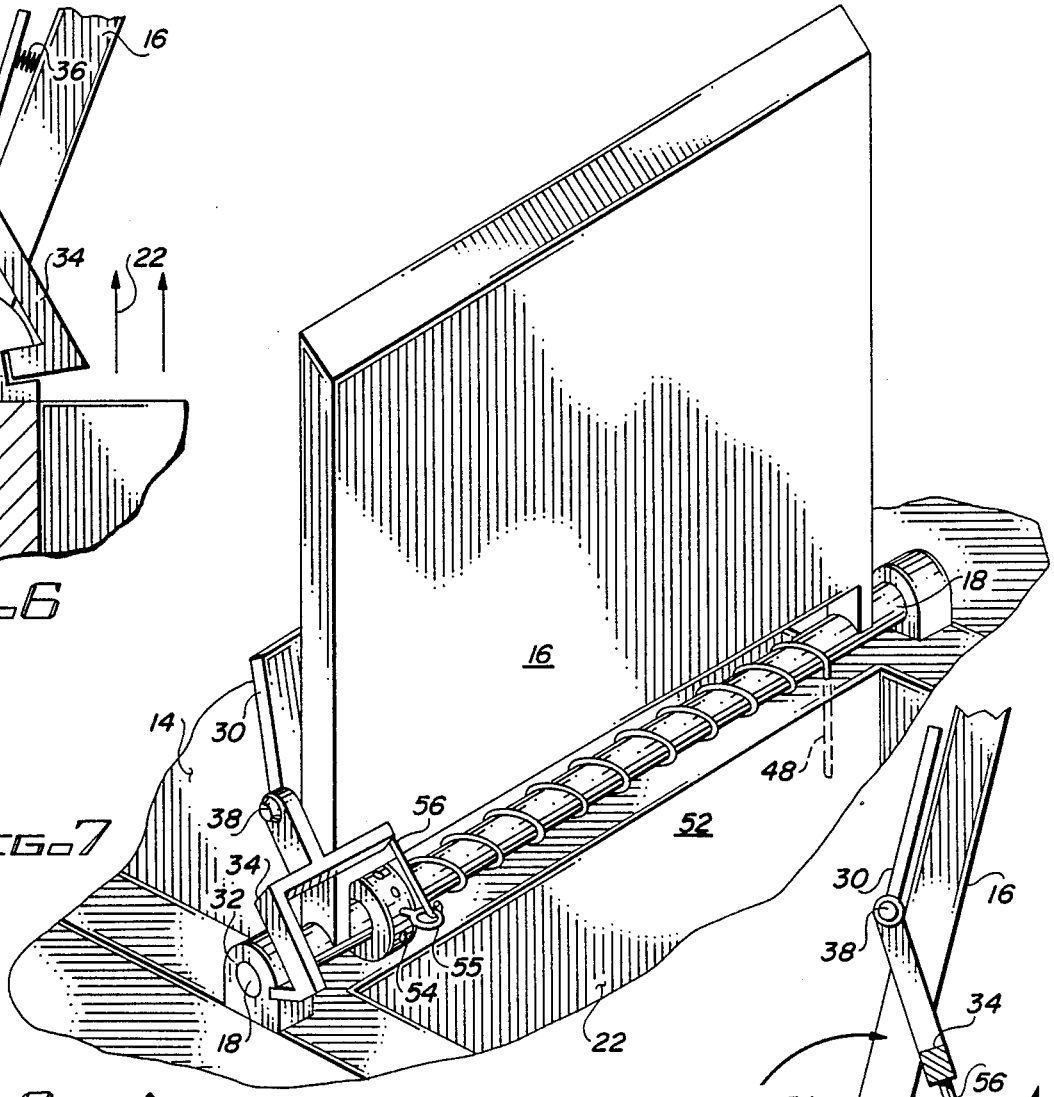
FIG. 7 is a perspective view of a torsion spring arrangement for spring loading the hatch cover hinge.

FIG. 7 is a perspective view of the spring loading arrangement for hatch cover hinge 18. One end of torsion spring 48 acts on hinge plate 52; the other end of torsion spring 48 engages wheel 54 to force hatch cover 16 toward an open position when it is unlatched. The torsion spring 48 is loaded by rotating wheel 54 which is locked in place to hinge shaft 18 by pin 55. Arm 56 extends from pawl 34 and is rigidly connected to drag flap 30 at drag flap hinge 38.

Figure 8:
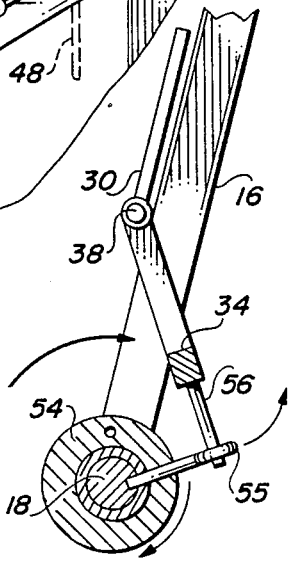
FIG. 8 is a sectional side view of a spring-loaded latching arrangement for the hatch cover.

FIG. 8 is an end view through wheel 54. Arm 56 locks into pin 55. The eyelet opening in pin 55 allows free play as pawl 34 moves to lock into the detent in hinge support 32, as previously described. When drag flap 30 is activated by rocket exhaust plume 28, pin 55 is pulled free of hinge shaft 18 and wheel 54 by the motion of arm 56 in unison with pawl 34 and drag flap 30. This action deactivates torsion spring 48. In the hatch cover 16 full-open position, the loads induced by torsion spring 48 on hinge shaft 18 and wheel 54 are near minimum, allowing a small tensile force exerted by arm 56 to release pin 55.

Figure 9:
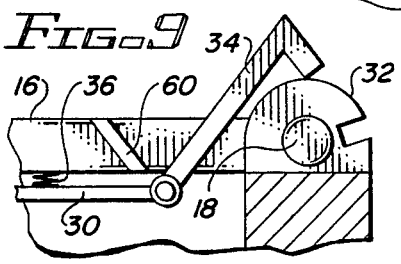
FIG. 9 is a side view of one possible embodiment of the drag flap shown in its closed position.
Figure 10:
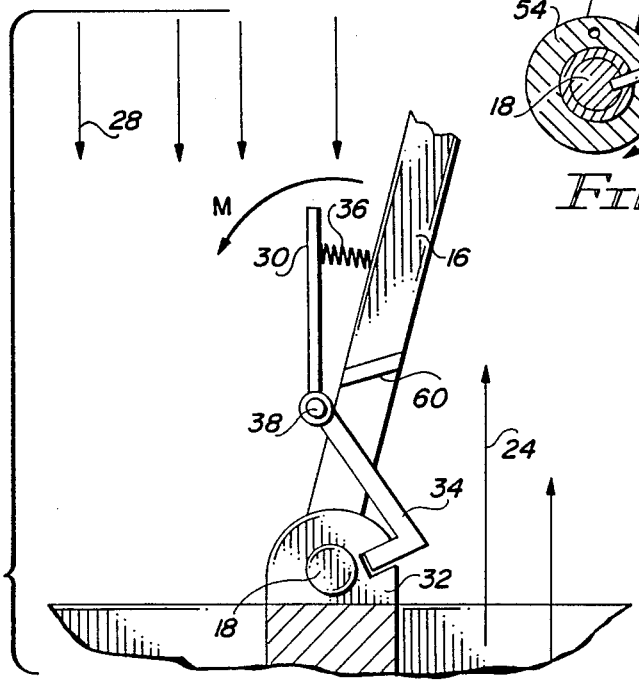
FIG. 10 is a side view of one possible embodiment of the drag flap shown a the onset of opening.

As shown in FIG. 9, one possible embodiment of drag flap 30 comprises a flat plate attached to the hatch cover 16 by means of a hinge 38. In its stowed position drag flap 30 makes a small acute angle with respect to the hatch cover 16. A weak spring 36 connects drag flap 30 with hatch cover 16. Spring 36 is just strong enough to overcome the weight of drag flap 30 and to force pawl 34 into the detent of hatch cover hinge support 32, and allows the angle between the drag flap 30 and hatch cover 16 to increase in response to the flow of exhaust plume 28 against drag flag 30, as shown in FIG. 10.

The pressure exerted by the exhaust 28 on drag flap 30 is much greater on the back side of drag flap 30 than the pressure on the front side of drag flap 30 because exhaust 28 stagnates in the region between the back side of the drag flap 30 and the hatch cover 16.

As long as any exhaust gas 28 can be driven between drag flap 30 and hatch cover 16, the acute angle can be any desired value. The larger (say up to 90°) the acute angle, the more readily the drag flap will be activated. A large acute angle may have the undesirable effect of drag flap interference with the missile during missile egress from the launch tube.

Figure 11:
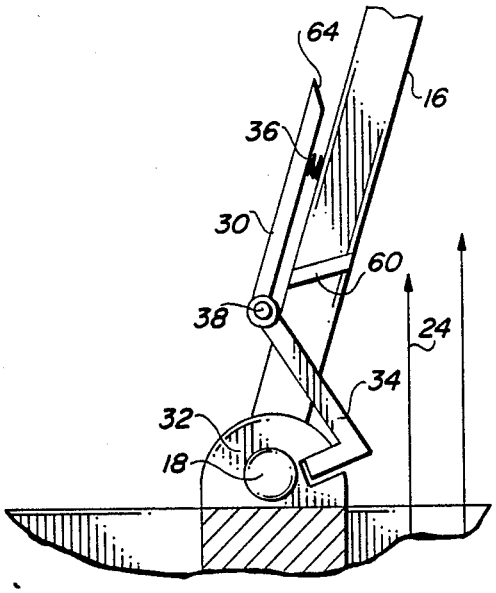
FIG. 11 is a side view of another possible embodiment of the drag flap shown in its open position.

An alternative embodiment of drag flap 30 with a lip portion 64 is shown in FIG. 11. This embodiment of drag flap 30 can lie flat against hatch cover 16 after pawl 34 has engaged the detent in hinge support 32 and still respond to forces exerted by exhaust plume 28. Either embodiment of drag flap 30 shown always remains deployed under the influence of exhaust 28. The exact shape of the flat portion of drag flap 30 in either embodiment is not critical. It must have sufficient surface area to respond satisfactorily to the flow in exhaust plume 28 and sufficient exhaust-pressure-induced moment to rotate the hatch cover 16 past the 90° position. The drag flap 30 opening angle with respect to the hatch cover 16 is mechanically limited to about 90° by stop 60 which limits the motion of pawl 34. Other angle limiting stops could be arranged on the drag flap hinge 38 or by cables or articulating arms attached to both hatch cover 16 and drag flap 30.

Figure 12:
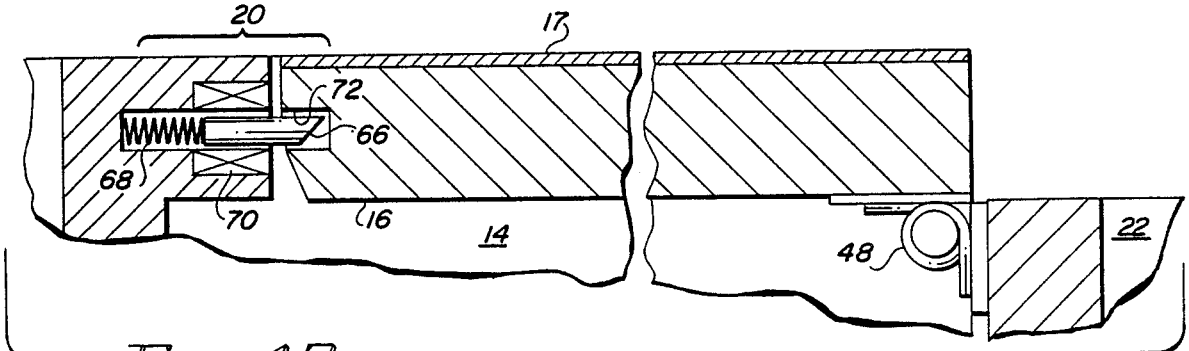
FIG. 12 is a side view of another possible embodiment of the drag flap shown in its closed position.

FIG. 12 shows one possible arrangement for the latching mechanism of cover latch 20. A tongue member 66 is attached to a spring 68, and serves as the armature in a solenoid 70. Tongue member 66 is engaged by mortise 72 in hatch cover 16 when cover 16 is in its closed position. Activation of solenoid 70 withdraws tongue member 66 from mortise 72 and allows hatch 16 to open in response to spring 48. Tongue member 66 is beveled on the bottom to allow hatch cover 16 to force withdrawal of tongue member 66 under excessive internal pressure on the bottom of hatch cover 16. Spring 68 resists withdrawal of tongue member 66 to the desired pressure on hatch cover 16.

Figure 13:
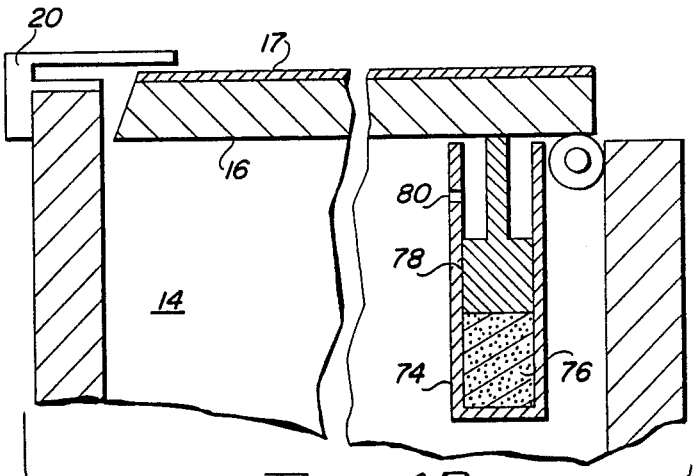
FIG. 13 is a sectional side view of an alternative embodiment of a way to provide a force on the hatch cover to open it when it is unlatched.

An alternative embodiment of a means to open hatch cover 16 when solenoid 70 is actuated is shown in FIG. 13. A cylinder 74 contains compressed gas 76 under high pressure which exerts an opening force on a piston 78 in contact with hatch cover 16 in its closed position. At full stroke a vent hole 80 is uncovered to automatically vent the high-pressure gas from cylinder 74, thus allowing hatch cover 16 to close with the absence of any resisting force.

Other alternative embodiments of means to open hatch cover 16, including motor and gear drive mechanisms, will be apparent to those versed in the art. Any are useful as long as the mechanisms are disabled either at hatch cover 16 full opening or upon actuation of drag flap 30 so as to minimize the drag flap moment M required to reclose the hatch cover 16 from beyond the 90° open position.

Figure 14:
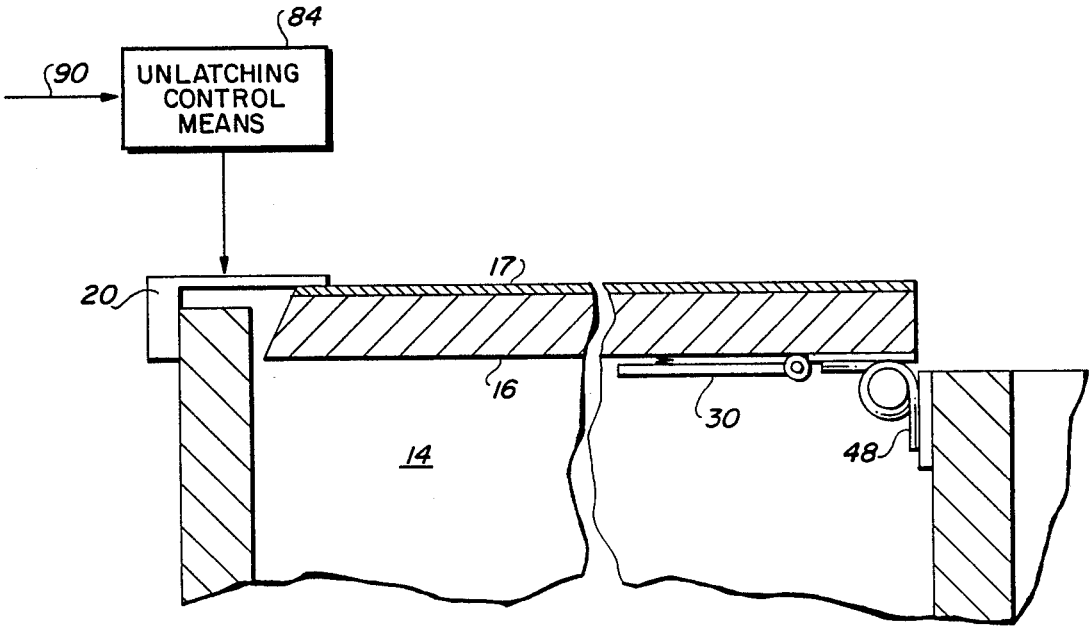
FIG. 14 is a schematic diagram of the unlatching control means in relation to the parts of the invention it controls.

FIG. 14 is a schematic diagram showing control means for operating various parts of the invention. Unlatching control means 84 powers the coil of solenoid 70 (shown in FIG. 12) to release hatch cover 16 from its closed position. A variety of solenoid operated mechanisms are available and well known in the art.

Unlatching control means 84 can be operated either manually or automatically. In the normal sequence of events, the unlatching control signal 90 is produced on command. It may be desirable to force open the hatch cover under excess internal pressure. Tongue member 66 is shown in FIG. 12 to provide for this embodiment, with spring 68 supplying the desired resistance to hatch opening.

The hatch cover deflector concept of the present invention can be implemented independently of the drag flap concept. Alternative means could be used to return the hatch cover deflector to its stowed position.

The drag flap concept can be utilized to close any cover (door) and/or to deactivate locking mechanisms or the like independently of the hatch cover deflector concept. For example, a missile canister hatch opening to a vertical position on the side away from an uptake flow can be closed immediately after missile clearance of the canister to eliminate the uptake flow onto the missile at the time of closure.

Although there have been described above specific arrangements of a rocket exhaust deflector in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A missile canister hatch comprising:

a hinged cover;

opening means for moving said cover from a closed position; and locking means for locking said cover open in a position which permits a missile to fly out of the canister while said open cover deflects part of the uptake rocket exhaust flow away from said missile as it is being fired.

2. The missile canister hatch of claim 1 in which said opening means is a mechanism employing a metal spring.

3. The missile canister hatch of claim 1 in which said opening means is a mechanism employing the expansion of a gas initially confined at high pressure.

4. The missile canister hatch of claim 1, further comprising latching means for latching said cover in said closed position.

5. The missile canister hatch of claim 1 further comprising closing means for moving said cover into a closed position after the missile has cleared the canister cover.

6. The missile canister of claim 5 wherein said closing means is a device acting in response to the exhaust flow from said missile as it is being fired.

7. The missile canister hatch of claim 5 wherein said closing means comprise a drag flap mounted on an interior side of said cover for moving said cover into a closed position in response to the exhaust flow from said missile as it is being fired.

8. The missile canister hatch of claim 5 in which said opening means is a spring-loaded hinge supported by a hinge support having a detent therein and said closing means comprise:

a drag flap attached to an inner side of said cover, having a first position substantially parallel and close to said inner side, and a second, open position in which said flap is no longer substantially parallel to said inner side of said cover;

a spring between and connecting said drag flap and said cover; and an arm rigidly attached to said drag flap, having an end which fits into said detent in said hinge support when said drag flap is in said first position, and which is withdrawn from said detent as said drag flap moves to said second position.

9. The missile canister hatch of claim 8 further comprising stop means on said cover to limit the rotation of said arm with respect to said cover under the influence of said rocket exhaust.

10. A missile canister hatch comprising:

an openable cover;

latching means for latching said cover in a closed position;

hinge means for allowing said cover to rotate open to a position where the open cover deflects uptake rocket exhaust flow;

restoring torque means for supplying a torque tending to rotate said cover to an open position;

unlatching control means for inactivating said latching means to open said hatch in response to an unlatching control signal;

locking means for maintaining said cover in said open position;

a drag flap attached to an inner side of said cover, having a first position almost parallel and close to said inner side of said cover, and a second, open position in which said flap is further away from said inner side of said cover;

unlocking means for disabling said locking means in response to a change in the position of said drag flap from said first position to said second position; and deploying means for allowing said drag flap to assume said second position under the influence of the rocket exhaust from said missile.

11. The missile canister hatch of claim 10 in which said restoring torque means comprise a torsion spring acting in concert with said hinge means, said spring having a first position in which a force is exerted on said hatch cover tending to open said cover, and a second position in which said spring does not exert said force on said cover.

12. The missile canister hatch of claim 10 in which said locking means comprise a spring-loaded pawl which, during opening of said cover, moves until it engages a detent in said hinge means.

13. The missile canister hatch of claim 10 in which said cover further comprises an ablative heat resistant material along at least one side of said cover.

14. The missile canister hatch of claim 10 in which said latching means comprise a spring-loaded tongue member in a mortise in said cover and said unlatching control means is a solenoid for withdrawing said spring-loaded tongue member from said mortise to open said cover.

15. The missile canister hatch of claim 10 in which said deploying means is mechanical and acts in response to the exhaust gas flow from said missile.

16. The missile canister hatch of claim 15 in which said deploying means is a beveled edge on the free end of said drag flap which activates said drag flap by allowing exhaust gases to be driven between said drag flap and said cover, said beveled edge forming an opening between said drag flap and said cover when said drag flap is in said first position.

17. A rocket exhaust deflection apparatus comprising:

a missile canister having a latchable, spring-loaded hinged cover at the fly out end of said canister, said cover having a deployable drag flap on an inner side;

a plenum communicating with a side of said missile canister; and an exhaust uptake flow channel communicating with said plenum and adjacent the hinged side of said canister cover.

18. A method of deflecting the uptake exhaust from a missile leaving a canister having a cover, comprising the steps of:

opening said cover from a closed position to an open position in which said cover opens more than 90 degrees with respect to said closed position;

locking said cover in said open position as said missile is leaving said canister; and deflecting a part of said uptake exhaust flow away from said missile by maintaining said open cover in the uptake exhaust stream.

19. A method of opening and closing a hatch for a missile canister having a cover, so that the exhaust from said missile flowing upwards through an adjacent uptake channel is deflected away from said missile as it leaves said canister, comprising the steps of:

opening said cover from a closed position to an open, locked position in which said cover opens more than 90° with respect to said closed position as said missile is leaving said canister and as a part of said exhaust flows through said uptake channel;

deploying a drag flap on said cover after said missile leaves said canister; and deactivating a locking mechanism which keeps said cover in said open position;

wherein torques exerted by said exhaust act on said drag flap and said cover to rotate said cover back toward a closed position.

20. A missile canister hatch comprising:

a cover;

opening means for moving said cover to an open position;

locking means for locking said cover in said open position, whereby said cover in said open position deflects part of the uptake rocket exhaust flow away from said missile as it is being fired;

closing means for moving said cover into a closed position, wherein said closing means comprise a drag flap mounted on an interior side of said cover for moving said cover into a closed position in response to the exhaust flow from said missile as it is being fired.

21. In an upright missile launching system having a missile storage and launch canister connected at its lower end by means of a plenum chamber to an exhaust uptake channel extending along the canister, a canister hatch comprising:

a cover pivotably mounted on the upper end of the canister so as to move from a closed position, in which the cover seals the upper end of the canister, to a locked open position, in which the cover serves to deflect exhaust gases discharged from the exhaust uptake channel away from a missile as it flies out of the canister; and means for releasing the cover from the locked open position after a missile has cleared the canister hatch and moving it to the closed position.

22. The combination of claim 21 wherein said last-mentioned means comprise a drag flap mounted on the cover which, when acted upon by the flow of exhaust from a missile as it flies out of the canister, forces the cover to the closed position.

23. The combination of claim 22 wherein said means for releasing the cover is activated by movement of the drag flap from a stowed position to an open position when acted upon by the flow of exhaust from a missile as it flies out of the canister.

* * * * *